United States Patent [19]

Calvert

[11] Patent Number: 4,561,342

[45] Date of Patent: Dec. 31, 1985

[54] SERIES SELF-LEVELING VALVE

[75] Inventor: Robert W. Calvert, Hutchinson, Kans.

[73] Assignee: The Cessna Aircraft Company, Wichita, Kans.

[21] Appl. No.: 517,177

[22] Filed: Jul. 25, 1983

[51] Int. Cl.[4] ..... F15B 13/06

[52] U.S. Cl. ..... 91/31; 91/514; 91/517; 91/520; 91/530

[58] Field of Search ..... 91/6, 31, 513, 514, 91/516, 532, 517, 518, 520, 530, 531, 438; 414/699, 700, 708, 712

[56] References Cited

U.S. PATENT DOCUMENTS

| | | | |
|---|---|---|---|
| 2,737,196 | 3/1956 | Eames | 91/516 |
| 3,033,168 | 5/1962 | Ruhl | 91/438 |
| 3,482,600 | 12/1969 | Hodgson | 91/438 |
| 3,703,186 | 11/1972 | Brewer | 91/516 |
| 4,337,787 | 7/1982 | Rhodes | 91/516 |
| 4,408,518 | 10/1983 | Diel et al. | 91/31 |

*Primary Examiner*—Robert E. Garrett
*Assistant Examiner*—Richard S. Meyer
*Attorney, Agent, or Firm*—Edward L. Brown, Jr.

[57] ABSTRACT

A self-leveling series type hydraulic system with a float position including boom and bucket valves which separately control boom and bucket cylinders and a flow divider valve positioned in the exhaust flow path from the rod end of the boom cylinder. The flow divider valve in one position splits the flow sending a portion of it to the cap end of the bucket cylinder so as to maintain the bucket in a level condition during raising of the boom with the remaining flow returning to the control valve downstream of the boom valve whereby the bucket valve can be separately actuated concurrent with the boom valve and supplied with oil so as to override the self-leveling function if desired. The flow divider valve having a second position which bypasses all of the flow from the boom cylinder to reservoir when the boom control valve is in a float position.

8 Claims, 4 Drawing Figures

SERIES SELF-LEVELING VALVE

BACKGROUND OF THE INVENTION

This invention relates generally to controls for hydraulic power systems and more specifically to directional control valves that selectively effect automatic leveling of a bucket on the front end of a loader or similar device during movement of the boom arm to which the bucket is attached.

It is conventional practice to provide a hydraulic cylinder and separate control valve for manipulating the bucket of a front end loader and a second cylinder and companion valve for aiding in raising and lowering the boom of a loader. In the absence of any self-leveling function, it is necessary for the operator of the loader to operate both valves, one with each hand, to maintain the bucket level while raising the boom. This operation is not only difficult but also requires the strict attention of the operator. The advantages of a self-leveling system are obvious and there have been numerous types of systems on the market for many years.

One of the more common methods, such as shown in U.S. Pat. No. 3,987,920, to Parquet, is a mechanical linkage tied to the frame of the loader which tilts the bucket, maintaining it level as the boom is raised or lowered.

Another common method, which is strictly hydraulic, is illustrated in U.S. Pat. No. 3,251,277 to Stacey. In this patent the fluid displaced from the boom cylinder is directed to the bucket cylinder by actuation of the boom spool alone. This type of system requires a matching of volumes so that the volume displacement from the boom cylinder will extend the bucket cylinder the precise distance to hold the bucket level as the boom is raised. This type of system is more expensive and bulky since it requires an unduly large bucket cylinder.

Another method is illustrated in U.S. Pat. No. 3,811,587 to Seaberg which utilizes a pair of hydraulic motors mechanically tied together with the larger motor located in the boom cylinder circuit while the smaller motor is located in the bucket circuit. As flow passes through the boom circuit, a proportionally smaller flow is forced through the bucket circuit.

Another self-leveling system is shown in U.S. Pat. No. 3,563,137 to Graber wherein the flow exiting the boom cylinder passes through a flow divider, dumping a portion to drain while directing the remaining portion to the bucket cylinder to maintain a level condition while raising the boom.

In the last-mentioned patent, the excess oil is removed from the self-leveling circuit by a proportional flow divider dumping to drain, however, such a system can only be used in a conventional parallel circuit as distinguished from a series type circuit of the present invention. A parallel circuit, as illustrated in the last-mentioned patent, provides a source of pump pressure to each valve spool in a parallel path. A series system such as U.S. Pat. No. 3,251,277 to Stacey provides a pump power passage in series through the particular valve in the system. In a series type valve, if an upstream valve is moved to an operative position, there is no pump pressure to the remaining downstream valves since the power passages are in series.

Series type valves are normally not adaptable to a self-leveling function with the exception of the last-mentioned patent to Stacey, and applicant's pending U.S. applications Ser. No. 244,831, now U.S. Pat. No. 4,408,518 and Ser. No. 464,071.

In U.S. Pat. No. 4,408,518, a flow divider is utilized in the boom discharge flow path with a portion going to the bucket cylinder while the remaining flow passes back to the valve to the boom return motor port. This last-mentioned flow through the boom return port provides downstream oil for the bucket cylinder if the operator attempts to override the self-leveling function while the boom cylinder is moving. The invention in U.S. Pat. No. 4,408,518 gives a downstream valve in a series circuit the added capacity of functioning during the movement of the blocking upstream valve; however, under certain conditions the override function of the bucket will not work.

In a three spool series circuit with the boom valve spool in self-level raise; the bucket spool in curl override; and a third spool pulled (which is downstream of the boom and bucket spool), the bucket will dump at the self-level rate instead of curling as commanded.

In applicant's second-mentioned application (Ser. No. 464,071) instead of dumping the return oil from the rod end of the bucket cylinder directly to tank, the return oil from the bucket cylinder is dumped back into the boom return motor port, thereby preventing the rod end of the bucket cylinder from dumping to tank. This insures that any increased pressure from the third downstream valve will act on the back side of the unloading spool, keeping it closed and allowing proper function of the bucket cylinder in the curl mode.

SUMMARY OF THE INVENTION

In both of the systems of the above-mentioned applications, providing the boom valve with a "float" position has proven to be a problem. The "float" position of a valve opens both of the motor ports to reservoir so that the boom is free to move in either direction. A "float-up" condition is when, for example, the machine is back-dragging the bucket across a filled trench and the rising ground causes the boom to lift. In a "float-up" condition, oil from the rod end of the boom cylinder must pass across the left end of the flow divider to get to tank. Since flow from the right side of the flow divider is blocked, any flow across the left side will cause the spool to shift leftwardly and block all flow through the self-level valve. This prevents the boom from floating-up, as commanded.

The basic problem is that a flow divider always wants to divide flow and if you block the flow on one side, the flow divider will not allow any flow on the other side.

The present invention causes the flow divider to have two different functions. In a normal raise operation, the flow divider divides flow while in a "float-up" position and the divider allows all of the oil to bypass to tank. This is accomplished by a sensing line from the head end of the boom cylinder which activates a servo holding the flow divider spool in a flow dividing position whenever there is pressure in the head end of the boom cylinder. There is always pressure in the head end of the boom cylinder except when in a "float" position. In "float", the servo is overcome by a spring and the flow divider spool is shifted to a bypass position.

It is therefore the principal object of the present invention to provide a series-type self-level valve wherein the boom valve has a float position.

Another object of the present invention is to provide a self-leveling system which is simple in design and less expensive than parallel systems.

Other objects and advantages of the present invention are described in or will become apparent from the following detailed description and accompanying drawings of the preferred embodiment.

DESCRIPTION OF THE PREFERRED EMBODIMENT

Figure 1:
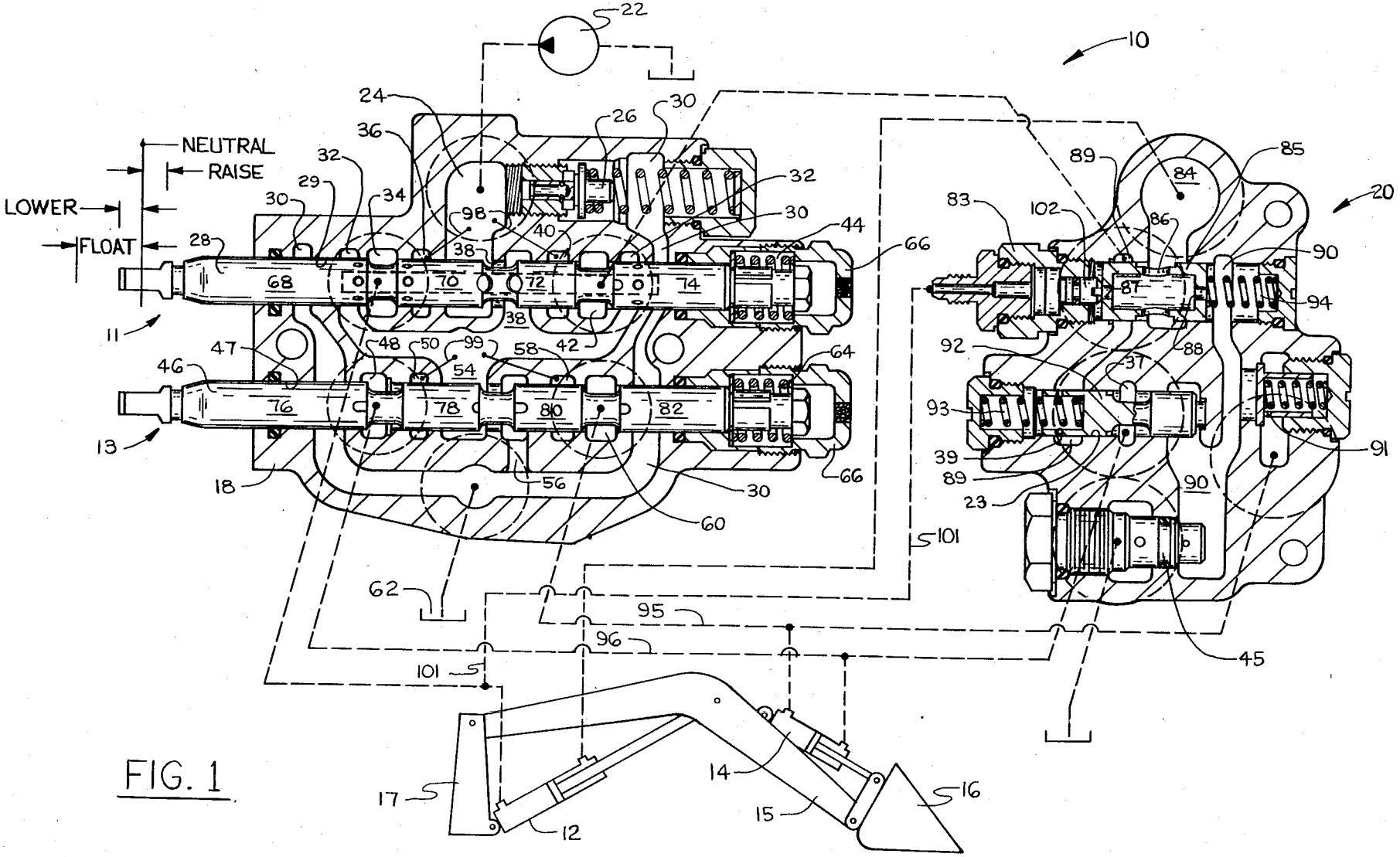
FIG. 1 is a partially schematic representation of the hydraulic controls for a front end loader including longitudinal sectional views of the boom and bucket valves neutrally positioned along with the flow divider valve.

With reference to the drawing, the overall self-leveling system is generally referred to by reference numeral 10. The system includes boom and bucket cylinders 12 and 14, respectively, which are controlled by boom and bucket directional control valves 11 and 13. Boom 15, which can be of many types, is pivotally mounted to the base frame member 17 of the loader (not shown) while bucket 16 is attached to the end of boom 15 and bucket cylinder 14. Positioned between the control valves 11 and 13, and the boom and bucket cylinders 12 and 14, respectively, is a flow divider valve 20, as seen in the drawing. Boom and bucket valves 11 and 13 are located in a common valve body 18 in a "series" type flow path, well known in the prior art.

Control valves 11 and 13 are supplied pump pressure from pump 22 through inlet cavity 24. Connected with pump inlet cavity 24 is a conventional system relief valve 26 which when the system pressure is exceeded in cavity 24, relief valve 26 opens, dumping pressure into reservoir cavity 30.

Boom valve spool 28 is positioned in a bore 29 which passes through valve body 18. From left to right, bore 29 first intersects reservoir cavity 30, return cavity 32, motor port cavity 34, power passage 36, pump inlet cavity 24, open center passage 38, power passage 40, motor port cavity 42, return cavity 32 and reservoir cavity 30. Power passages 36 and 40 are always open to pump inlet cavity 24 via passages 98 (symbolically shown). Attached to the right end of spool 28 is a conventional centering spring mechanism 44 which returns the valve spool to its neutral position, as indicated in FIG. 1.

Figure 4:
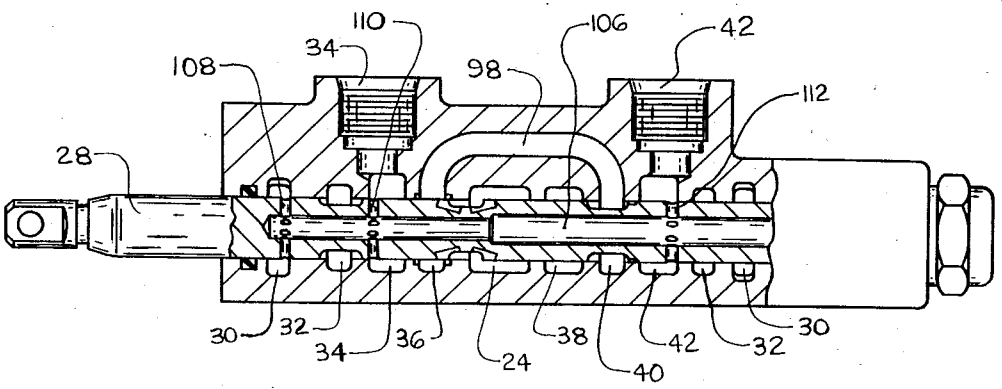
FIG. 4 is a longitudinal sectional view of the boom valve in its float position.

Spool 28, as shown in FIG. 4, is positioned in a "float" position whereby both motor ports 34 and 42 are opened to reservoir via longitudinal passage 106 and lateral passages 108, 110 and 112. A "float" position allows the boom to freely move up or down, as for example, when backfilling a trench.

Bucket valve spool 46 is positioned in a bore 47 which also passes through valve body 18. Bucket spool bore 47, from left to right, first intersects reservoir cavity 30, motor port cavity 48, power passage 50, open center cavity 54, downstream open center cavity 56, power passage 58, motor port cavity 60 and reservoir cavity 30. Power passages 50 and 58 are always open to open center cavity 54 via passages 99 (symbolically shown). U-shaped reservoir cavity 30 drains to reservoir 62 at all times regardless of the positions of valve spool 28 and 46. Attached to the right end of valve spool 46 is a common centering spring 64 covered by a conventional vented cap 66.

Boom valve spool 28 includes, from left to right, valve spool lands 68, 70, 72 and 74, while bucket valve spool 46 includes valve spool lands 76, 78, 80 and 82, respectively.

Figure 3:
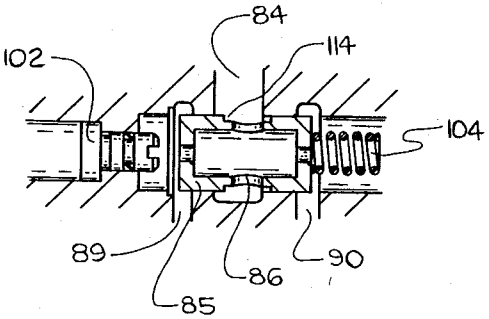
FIG. 3 illustrates the flow divider spool in a flow-dividing position.

Flow divider valve 20 includes an inlet cavity 84 which supplies a shuttle spool 85 through a pair of lateral openings 86 in the center of the spool. Located in the left and right ends, respectively, of spool 85 are fixed orifices 87 and 88 which are sized to create whatever flow proportion is desired. Shuttle spool 85 is slidably positioned in a bore which intersects boom motor port cavity 89 on its left end and bucket motor port cavity 90 on its right end. In a static condition, a light spring 94 urges spool 85 against a servo piston 102. The spool 85 will flow-divide whenever servo piston 102 is extended, as in the FIG. 1 and FIG. 3 positions. When servo piston 102 is not extended (float position), such as FIG. 2, spool 85 does not flow-divide, but rather bypasses all of the flow from inlet 84 to cavity 89 across groove 114. Servo piston 102 senses the pressure in the head end of boom cylinder 12 through sensing line 101 and therefore, whenever valve spool 28 is in the float position (FIG. 4), servo piston 102 is retracted and spool 85 is bypassing all of its flow across groove 114.

The ends of shuttle spool 85 in cavities 89 and 90 function as variable orifices governed by the pressure drop across fixed orifices 87 and 88, respectively. A detailed description of the flow-dividing function of shuttle spool 85 is given in U.S. Pat. No. 3,563,137, mentioned above.

The divided flow from valve 20 is split into two flow paths, with the first exiting boom motor port cavity 89 to boom motor port 42, and the second flow path exiting cavity 90 across check valve 91 to bucket motor port 60.

Also located in flow divider valve 20 is an unloading valve spool 92 positioned in a bore 23 which intersects boom motor port cavity 89. In the absence of pressure in cavity 90, or when the pressures in cavity 89 are equal to or greater than that in cavity 90, the spool 92 is held in a closed position by spring 93, as shown in the drawing. Pressure in cavity 89 acts on the left end of spool 92 through bleed opening 39. When pressure in cavity 90 exceeds the force of spring 93 and the pressure in cavity 89; spool 92 opens cavity 37 into motor port cavity 89.

The boom and bucket control valves 11 and 13, are conventional valves normally used in a more basic system which does not self-level. In such a system, the boom and bucket valves 11 and 13 would be connected only to their respective cylinders 12 and 14.

OPERATION

With boom and bucket spool 28 and 46 in their neutral positions, as indicated in FIG. 1, there is no pressure buildup in inlet cavity 24 since the pump flow freely passes through open center passages 38, 54 and 56 back to reservoir 62. If it is the intent of the operator to raise the boom 15 while maintaining the bucket 16 in a level position, boom valve spool 28 is moved to the right to the raise position (as indicated at the left end of the spool 28). In the raise position, spool land 70 blocks flow through open center passage 38 causing pressure to build in inlet cavity 24 while the left edge of land 70 opens power passage 36 to motor port 34 (via passage 98) allowing pump pressure to enter the cap end of boom cylinder 12. As the boom 15 begins to raise, the discharge flow from the rod end of cylinder 12 enters inlet cavity 84 of the flow divider valve 20. From cavity 84, fluid enters the center of shuttle spool 85 through lateral openings 86 and exits in a split path through the two fixed orifices 87 and 88 at the opposite ends of the spool 85. Since the shuttle spool 85 is initially located in its most leftwardly position, as shown in FIG. 1, against piston 102, the initial flow will all be across orifice 88. However, as soon as flow begins across orifice 88, the spool will shift rightwardly due to the imbalance of forces acting on the opposite ends of the spool caused by a pressure drop across orifice 88, and allow flow to begin across orifice 87 and into cavity 89. Regardless of the amount of flow into the divider valve or the pressure levels it reaches, the shuttle spool 85 will proportionally divide or split the flows into cavities 89 and 90, respectively, with the proportion being preset by the comparative orifice sizes of orifices 87 and 88.

As the boom 15 continues to rise, the flow is split at flow divider valve 20, with a portion of the flow passing to the head end of bucket cylinder 14 via cavity 90, across check valve 91. The other split flow in cavity 89 flows back through boom motor port 42. The left edge of land 74 on the boom spool 28 opens port 42 to return cavity 32, which in turn is open to reservoir 62 as long as bucket spool 46 has its open center cavities 54 and 56 open.

The flow exhausting from the rod end of bucket cylinder 14 enters flow divider valve 20 through cavities 37 and across unloading valve spool 92 via cavity 89 into boom motor port 42, as long as the pressure in cavity 90 exceeds that in cavity 89 plus the spring force. If bucket cylinder 14 attempts to overspeed and cavitate due to the weight in the bucket, the pressure in the head end of cylinder 14 drops to zero which is felt in cavity 90, allowing unloading spool 92 to shift to the right due to spring 93 and block the flow from the rod end of bucket cylinder 14 to drain, thereby stopping movement of the cylinder until sufficient pressure against builds in the head end of cylinder 14.

If during the raising of the boom 15, the operator decides to override the self-leveling function, and dump the bucket as the boom is rising; the operator would move the bucket spool 46 to the left from its neutral position, as shown in the drawing. Land 80 on the bucket spool would block the open center flow through cavities 54 and 56, thereby building pressure in cavity 54 upstream of the bucket spool 46 since there is return flow entering motor port 42 from the flow divider valve 20. This split flow from cavity 89 which normally is passed to drain across the open center cavity 54 of the bucket, is now blocked at the open center cavity 54 and is forced into power passage 58 (via passage 99). With spool 46 shifted to the left, the right hand edge of valve spool land 80 opens power passage 58 to motor port 60, which in turn connects with the head end of bucket cylinder 14. The rod end of bucket cylinder 14 is open to drain across line 96 into motor port 48 and drain passage 30. Since the split flow from flow divider 20 is supplied to the return side (port 42) of the boom cylinder, there is fluid pressure available upstream of bucket spool 13 (via the edge of land 74, passages 32 and 38) to effect an overriding function when the boom cylinder is in a raise position.

Flow divider valve 20 has a different function when the flow direction through the valve is reversed, such as when boom spool 28 is moved to the left to its lower position. Open center flow is blocked building pressure in cavity 24 while the right edge of land 72 opens power passage 40 to motor port 42 causing pressure to flow in a reverse direction into the left end of shuttle spool 85. Pressure in cavity 89 forces shuttle spool 85 to its far right position blocking any flow to cavity 90 with all of the flow passing through cavity 84 to the rod end of boom cylinder 12. Flow divider valve 20 has now become a shut-off valve to any flow in cavity 90 that might flow to the bucket cylinder 14.

FLOAT POSITION OPERATION

Figure 2:
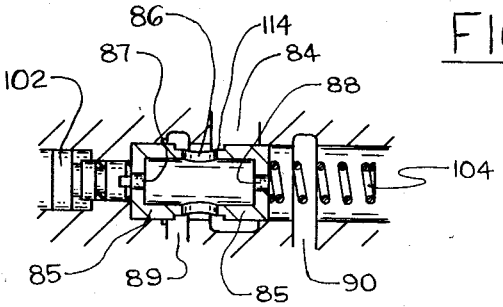
FIG. 2 illustrates the flow divider spool in its float position bypassing the normal function of the spool.

With boom spool 28 in the float position, as shown in FIG. 4, both motor ports 34 and 42 are open to reservoir passage 30, whereby the boom 15 is free to move up or down without pressure on either side. In a "float-up" condition, as for example when a loader is back-dragging the bucket across a filled trench, and the ground causes the boom to raise; oil from the rod end of boom cylinder 12 must pass across the left end of shuttle spool 85. Since there is no pressure in the head end of boom cylinder 12, servo piston 102 will be in its retracted position, as illustrated in FIG. 2, due to the force of spring 104. Shuttle spool 85 in this position no longer acts as a flow divider but bypasses all of the flow across spool groove 114 into cavity 89, which in turn flows to reservoir via motor port 42, passages 112, 106 and 108.

Having described the invention with sufficient clarity to enable those familiar with the art to construct and use it, I claim:

1. A self-leveling system controlling a boom and bucket including boom and bucket double-acting cylinders controlled by separate boom and bucket directional control valves in an open center series circuit with the boom control valve having a float position located upstream of the bucket control valve, a pressure source supplying the valves in a series path across the open center path of each valve to reservoir, the improvement comprising:

a flow dividing valve means spring-biased in one direction connected to the rod end of the boom cylinder which splits the flow from the boom cylinder into two flow paths in a first position;

a first passage means connecting the first of said two flow paths with an end of the bucket cylinder so as to maintain the bucket in a level position as the boom raises;

a second passage means connecting the second of said two flow paths with a boom motor port whereby the bucket valve can be separately actuated concurrent with the boom valve, and the flow dividing valve having a second position bypassing all of the flow from the boom cylinder to the second passage means;

a separate servo means for positioning said flow dividing valve means in the first or second position;

a sensing line connecting the servo means to the head end of the boom cylinder whereby the servo means positions the flow dividing valve means in its second position under certain pressure levels in the head end of the boom cylinder.

2. A self-leveling system as set forth in claim 1, wherein the boom control valve is a four-position four-way valve with a float position, and the bucket control valve is a three-position four-way valve with each valve having two motor ports, and the second passage means connects the second flow path to one of said boom motor ports whereby the second flow path can supply the bucket cylinder with pressurized fluid whenever desired.

3. A self-leveling system as set forth in claim 1, wherein the boom and bucket control valves are four-way valves, each having two motor ports, and the second passage means connects the second flow path to one of said boom motor ports, and the flow dividing valve means functions in a third position as a shut-off valve as to flow to the bucket cylinder when there is reverse flow through said flow dividing valve means with pressure from the boom control valve.

4. A self-leveling system as set forth in claim 1, including a third passage means connecting the opposite end of the bucket cylinder with the second passage means whereby the bucket cylinder discharge is returned to the system upstream of the bucket control valve.

5. A self-leveling system as set forth in claim 1, including a third passage means connecting the opposite end of the bucket cylinder with the second passage means, a servo operated shut-off valve in said third passage normally spring-biased closed, blocking flow in the third passage and servo means for opening the shut-off valve acting against said biasing means sensing pressure in the cap end of the bucket cylinder so as to prevent flow from the rod end of the bucket cylinder except when there is positive pressure in the cap end of the bucket cylinder.

6. A self-leveling system as set forth in claim 1, wherein the flow dividing valve means includes a hollow shuttle spool positioned in a bore with center inlet openings in the spool and a pair of outlet orifices, one in each end of the spool, for measuring the pressure drop in each of said two flow paths, the ends of the spool and adjacent portions of the bore acting as variable orifices for splitting the flow in a desired proportion.

7. A self-leveling system as set forth in claim 1, wherein the flow dividing valve means includes a hollow shuttle spool positioned in a bore with center inlet openings in the spool and a pair of outlet orifices, one in each end of the spool, for measuring the pressure drop in each of said two flow paths, the ends of the spool and adjacent portions of the bore acting as variable orifices for splitting the flow in a desired proportion, and a bypass groove in the shuttle spool which in its second position passes all of the flow from the boom cylinder to the second passage means.

8. A self-leveling system as set forth in claim 1, wherein the flow dividing valve means includes a hollow shuttle spool positioned in a bore with center inlet openings in the spool and a pair of outlet orifices, one in each end of the spool, for measuring the pressure drop in each of said two flow paths, the ends of the spool and adjacent portions of the bore acting as variable orifices for splitting the flow in a desired proportion; biasing means urging the shuttle spool toward its second position, and said servo means comprises a separate piston which contacts the shuttle spool in opposition with the biasing means, maintaining the shuttle spool in its first position when the servo piston is extended.

* * * * *